US011957232B2

(12) United States Patent
Bourguignat et al.

(10) Patent No.: US 11,957,232 B2
(45) Date of Patent: Apr. 16, 2024

(54) APPLICATOR SYSTEM FOR APPLYING A COSMETIC PRODUCT

(71) Applicant: ELC MANAGEMENT LLC, Melville, NY (US)

(72) Inventors: David Bourguignat, Brooklyn, NY (US); Marc Emile Lechanoine, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 17/682,771

(22) Filed: Feb. 28, 2022

(65) Prior Publication Data

US 2023/0270235 A1 Aug. 31, 2023

(51) Int. Cl.
*A45D 40/26* (2006.01)
*A45D 34/04* (2006.01)

(52) U.S. Cl.
CPC ..... *A45D 40/262* (2013.01); *A45D 34/042* (2013.01); *A45D 2200/054* (2013.01); *A45D 2200/1009* (2013.01); *A45D 2200/1018* (2013.01)

(58) Field of Classification Search
CPC ..... A45D 40/262; A45D 34/042; A45D 2200/1018; A45D 2200/054; A45D 34/04; A45D 40/26; A45D 2200/1009; A46B 11/0041; B65D 47/42; B65D 47/44
USPC ..... 401/183–186, 261–266
See application file for complete search history.

(56) References Cited

U.S. PATENT DOCUMENTS 2,820,234 A * 1/1958 Rigney ..... A47L 17/00 401/207
3,284,839 A * 11/1966 Cook ..... A45D 34/041 401/208
5,299,877 A * 4/1994 Birden ..... B65D 47/42 401/196
6,505,986 B1 * 1/2003 Oder ..... A45D 24/26 222/211
6,942,412 B2 * 9/2005 Gueret ..... B65D 47/42 401/262

(Continued)

FOREIGN PATENT DOCUMENTS

EP 2219976 B1 1/2012
EP 2929802 A1 10/2015
JP 2004-051170 A 2/2004

OTHER PUBLICATIONS

International Application No. PCT/US2023/063134, International Search Report and Written Opinion, dated Jun. 26, 2023.

*Primary Examiner* — David J Walczak
(74) *Attorney, Agent, or Firm* — MARSHALL, GERSTEIN & BORUN LLP

(57) ABSTRACT

An applicator system for containing and dispensing a cosmetic substance may include a flexible container defining a cavity and including an open first end and a closed second end, a dispensing mechanism extending from the open first end into the cavity towards the second end, and an applicator operably coupled with at least a portion of the dispensing mechanism. The applicator has a body and an external surface. Upon exerting a force on a portion of the flexible container, a predetermined quantity of cosmetic substance is dispensed from the cavity, through the dispensing mechanism, through the body of the applicator to the external surface of the applicator.

11 Claims, 5 Drawing Sheets

(56) References Cited

U.S. PATENT DOCUMENTS

| | | | |
|---|---|---|---|
| 7,455,195 | B2 | 11/2008 | Mekata |
| 10,435,228 | B2 | 10/2019 | Nakajima et al. |

* cited by examiner

APPLICATOR SYSTEM FOR APPLYING A COSMETIC PRODUCT

FIELD OF THE DISCLOSURE

The present disclosure generally relates to cosmetic, hair care, body care, and/or skincare products and, more particularly, to systems and approaches for applying such products.

BACKGROUND

Cosmetic, hair care, body care, and/or skincare products may be provided in a number of different containers, and may be applied using a number of varying approaches. As an example, a concealer product may be applied using a user's finger, an applicator brush, and/or a sponge product, among other alternatives. When applying such products, it may be difficult for a user to accurately dispense an appropriate quantity of product to provide coverage for the desired area. In instances where too much product is dispensed from the flexible container, the excess product may be difficult and/or impossible to return to its container, and ultimately may need to be discarded, thereby resulting in wasted product. Conversely, in instances where too little product is dispensed from the flexible container, the user's experience may be adversely impacted due to needing to repeatedly dispense additional product. Additionally, existing approaches may lack customization capabilities and may be difficult to use when attempting specific application techniques. Further, existing products may be disposable in nature, and as such may lead to environmental waste.

Accordingly, there is a need for improved accessories having improved functionalities.

SUMMARY

Examples within the scope of the present disclosure are directed to an applicator system for containing and dispensing a cosmetic substance. Such a system may include a flexible container defining a cavity and including an open first end and a closed second end, a dispensing mechanism extending from the open first end into the cavity towards the second end, and an applicator operably coupled with at least a portion of the dispensing mechanism. The applicator has a body and an external surface. Upon exerting a force on a portion of the flexible container, a predetermined quantity of cosmetic substance is dispensed from the cavity, through the dispensing mechanism, through the body of the applicator to the external surface of the applicator.

In an approach, the applicator system further includes a flexible neck member. The flexible neck member may flex in response to the applicator being urged by a user.

In these and other approaches, the dispensing mechanism may include at least one orifice restriction. The at least one orifice restriction may be constructed from a material having a Shore D hardness between approximately 50 and 75. Further, in some examples, the at least one orifice restriction may be in the form of a one-way valve that closes upon dispensing the predetermined quantity of cosmetic substance. In some forms, the predetermined quantity of cosmetic substance is approximately 10 microliters.

In some examples, the dispensing mechanism extends into the cavity towards the second end of the flexible container. The dispensing mechanism may include a dip tube plunger having an elongated tube member. In some examples, the elongated tube member may extend to the second end of the flexible container such that the cosmetic substance is dispensable from the flexible container in an upright orientation.

In some approaches, the applicator includes a flow through head that diffuses the cosmetic substance to the external surface thereof. The applicator may be constructed from an open cell foam material.

In some examples, the flexible container may have a rectangular or ovoid shape. Further, in some examples, the flexible container may have a generally tapered profile extending from the first end to the second end.

BRIEF DESCRIPTION OF THE DRAWINGS

The above needs are at least partially met through provision of one, more than one, or any combination of the approaches for applicator systems for applying a cosmetic product described in the following detailed description, particularly when studied in conjunction with the drawings, wherein.

Figure 1:
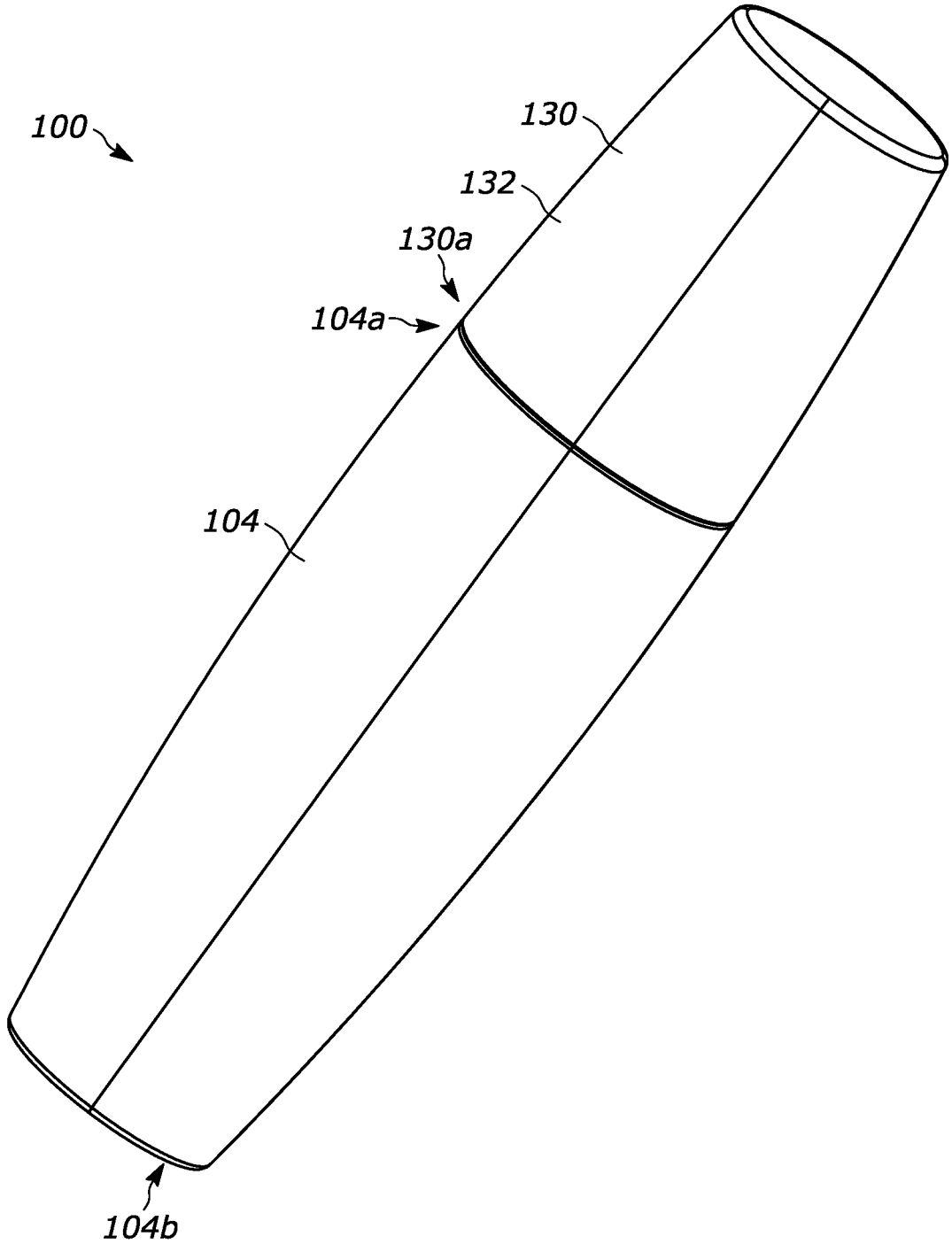
FIG. 1 illustrates a perspective view of an example applicator system in accordance with various examples.
Figure 2:
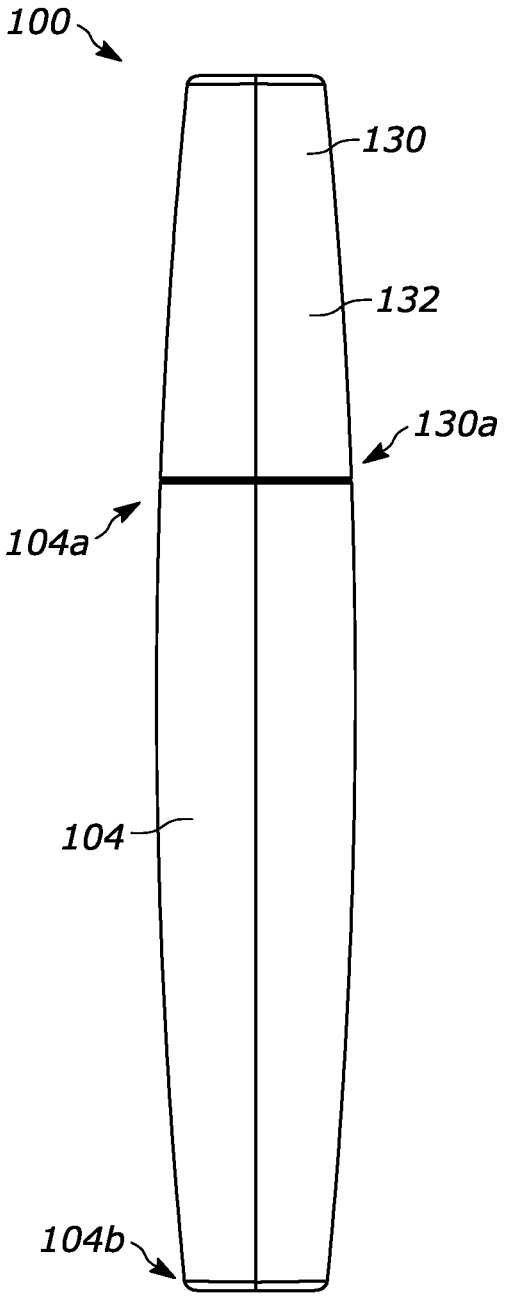
FIG. 2 illustrates a side elevation view of the example applicator system of FIG. 1 in accordance with various examples.
Figure 3:
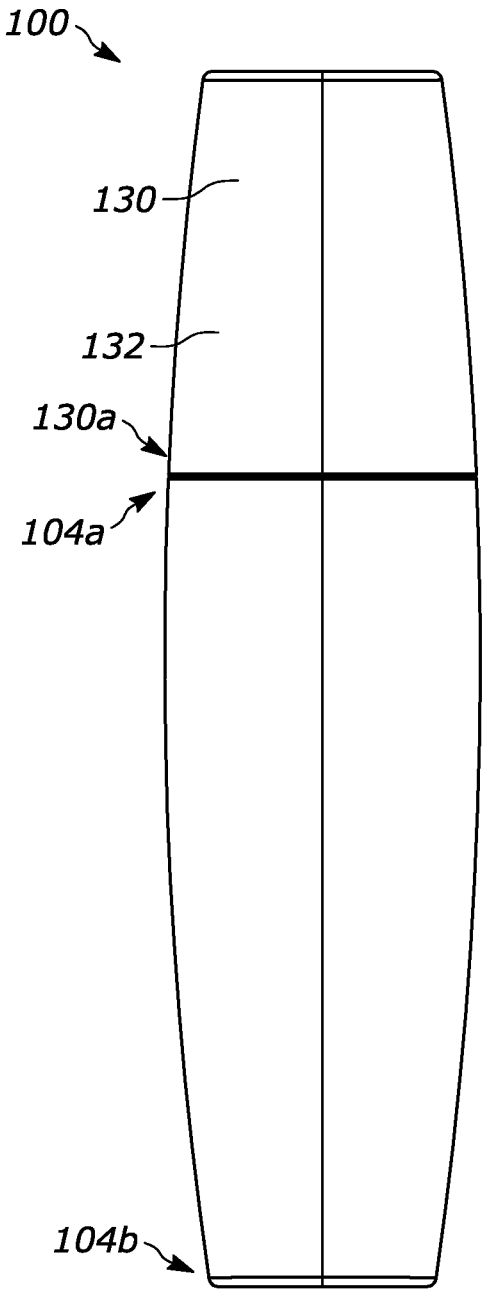
FIG. 3 illustrates a front elevation view of the example applicator system of FIGS. 1 & 2 in accordance with various examples.
Figure 4:
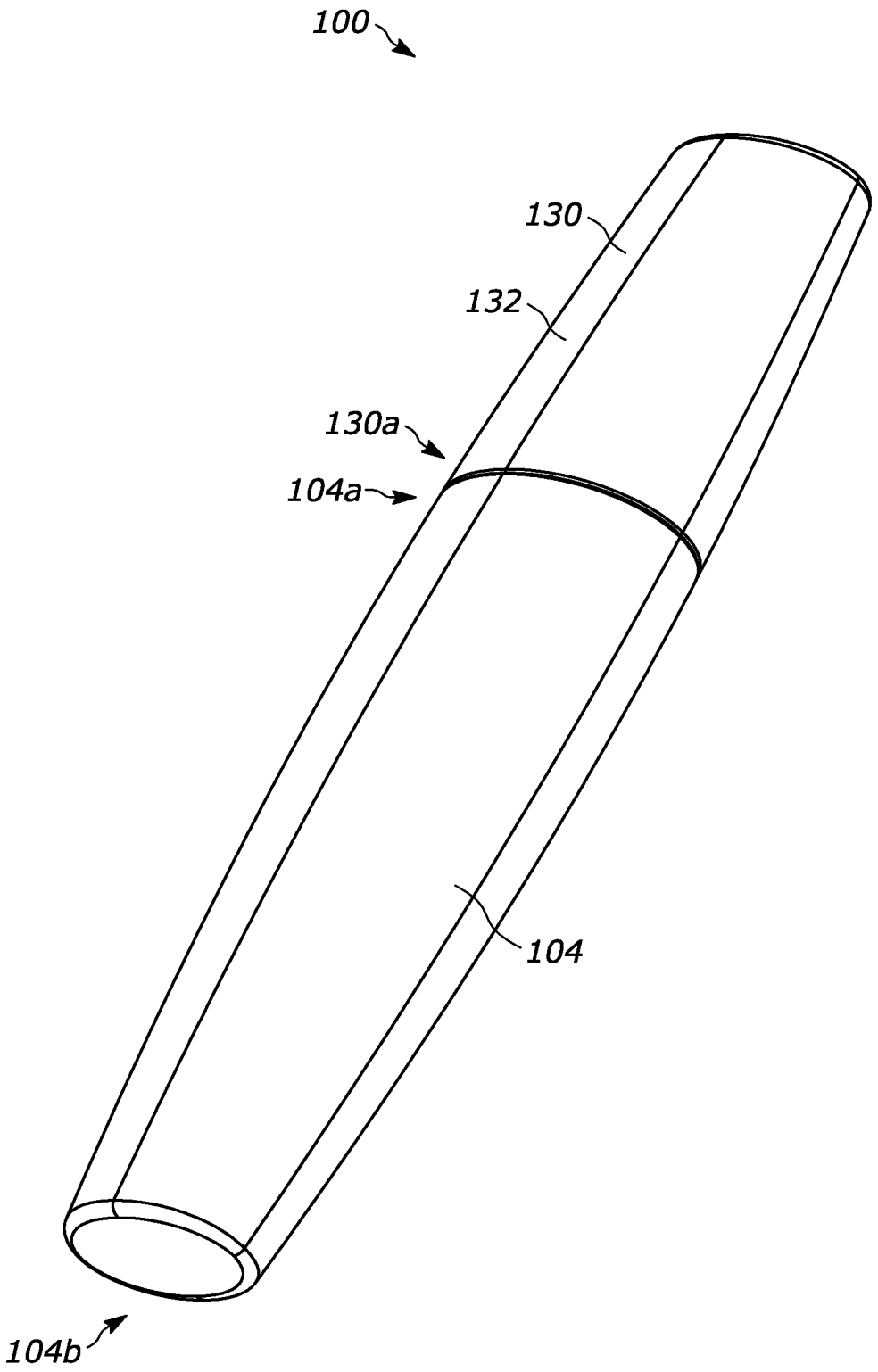
FIG. 4 illustrates a lower perspective view of the example applicator system of FIGS. 1-3 in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, an applicator system is provided that allows a user to precisely dispense and apply a controlled, predetermined quantity (e.g., a micro dosage) of a cosmetic, a hair care, a body care, and/or a skincare product such as, for example, a concealer formula, and allows the product to be applied and blended in an ergonomic and even manner. In some examples, the system may reduce air bubbles and/or other inconsistencies during dispensing and application, thereby providing a smooth application that reduces and/or eliminates texture marks.

Turning to the Figures, an applicator system 100 is provided for containing and dispensing a cosmetic substance 102. The applicator system 100 includes a flexible container or cartridge 104, a dispensing mechanism 110, and an applicator 120. The cosmetic substance 102 may be any type of cosmetic, hair care, body care, and/or skincare product that may be applied to a user. For example, the cosmetic substance 102 may be in the form of a concealer formula. Other examples are possible. In some examples where the cosmetic substance 102 is a cosmetic formula, it may include strong or otherwise aggressive chemicals and/or solvents such as, for example, volatiles.

Figure 5:
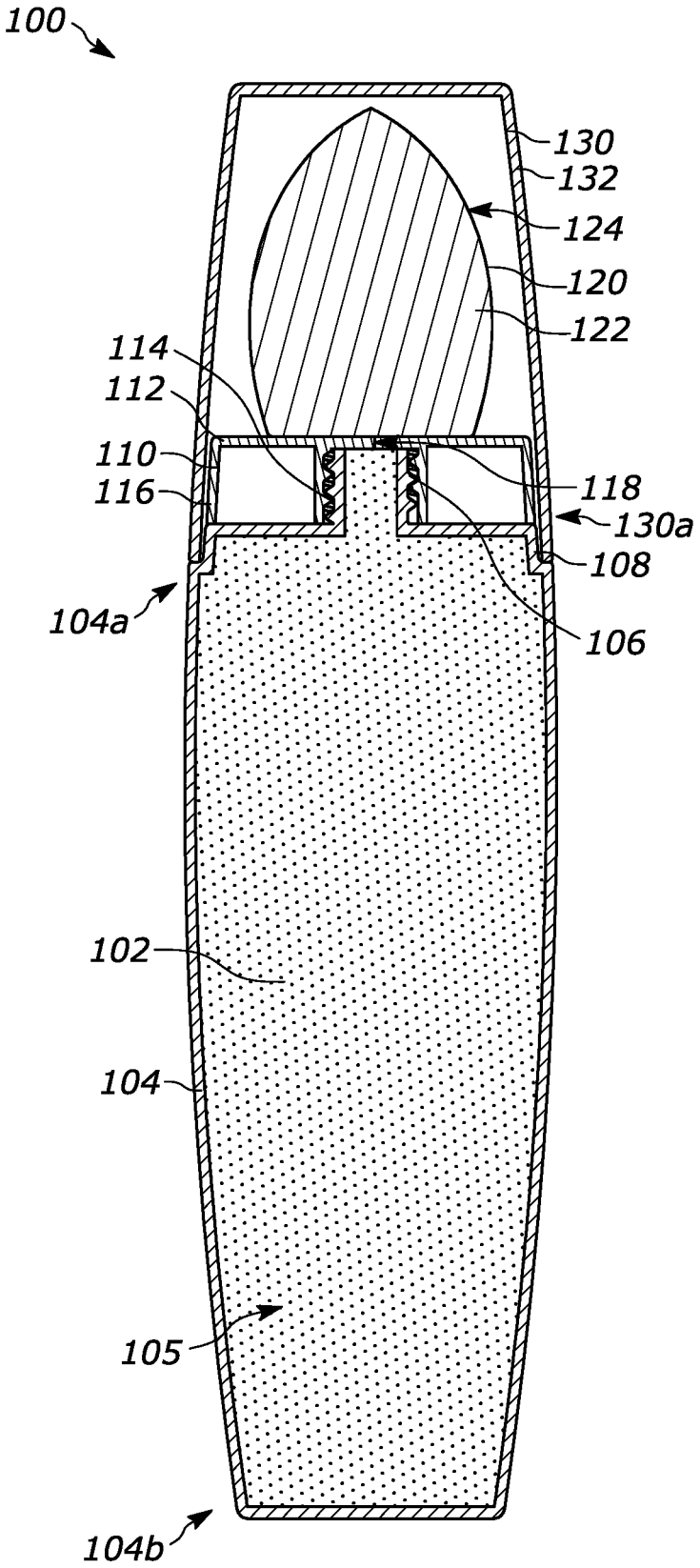
FIG. 5 illustrates a front elevation cross-sectional view of the example applicator system of FIGS. 1-4 in accordance with various examples.
Figure 6:
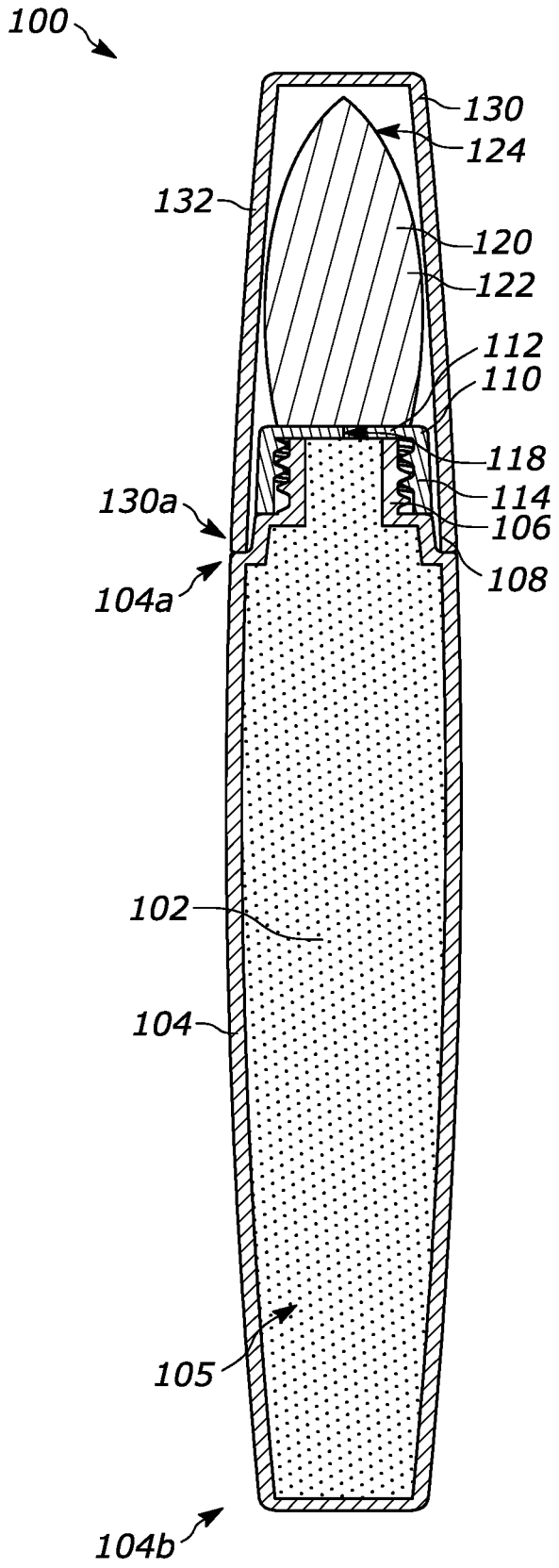
FIG. 6 illustrates a side elevation cross-sectional view of the example applicator system of FIGS. 1-5 in accordance with various examples.

The flexible container 104 has a first end 104*a*, a second end 104*b*, and a ledge 108. The flexible container 104 defines a cavity 105 dimensioned to retain the cosmetic substance 102. The flexible container 104 may be constructed from any number of suitable flexible materials such as, for example, a polymeric material. Other examples are possible. In some examples, the first end 104*a* of the flexible container 104 may be open, and the second end 104*b* of the flexible container 104 may be closed. As illustrated in FIGS. 5 & 6, in some examples, the first end 104*a* of the flexible container 104 may be in the form of a neck portion that includes a threaded coupling region 106. In some examples, the flexible container 104 may be at least partially constructed from a transparent and/or a translucent material, and may accommodate between approximately 3 ml and approximately 15 ml of cosmetic substance 102. More specifically, in some examples, the cavity 105 may be dimensioned to accommodate approximately 6 ml of cosmetic substance 102. In some forms (not illustrated), the flexible container 104 may be configured to receive an internal pouch that may be removable therefrom.

The dispensing mechanism 110 is disposed at or near the first end 104*a* of the flexible container 104 and is operably coupled therewith. The dispensing mechanism 110 is in the form of a wing or a cap that includes a base 112, a threaded coupling region 114 extending from the base 112, and a sidewall 116 also extending from the base 112. In some examples, all or a portion of the dispending mechanism 110 is constructed from a resilient material capable of flexing or bending upon being urged or pressed. More specifically, in some examples, the dispensing mechanism 110 may be constructed from a bi-injected soft touch material such as a fluorosilicate. Other examples are possible.

As illustrated in FIGS. 5 & 6, the threaded coupling region 114 of the dispensing mechanism 110 threadably couples with the threaded coupling region 106 of the flexible container 104. In the illustrated examples, the threaded coupling region 114 of the dispensing mechanism 110 surrounds the neck portion of the flexible container 104, but in other examples (not illustrated), an opposite configuration may be provided. Further, it is appreciated that any other suitable coupling mechanisms may be used such as, for example, a friction-fit coupling, a tab and protrusion coupling, and the like. Other examples are possible. So arranged, a portion of the base 112 covers the first end 104*a* of the flexible container 104 to assist with retaining the cosmetic substance 102 within the cavity 105. When the dispensing mechanism 110 is coupled with the flexible container 104, the sidewall 116 of the dispensing mechanism 110 may be positioned at or near and/or engage the ledge 108 of the flexible container 104.

In some examples, the dispensing mechanism 110 includes at least one orifice restriction 118. More specifically, in these examples, the orifice restriction 118 may be formed on or in the base 112 of the dispensing mechanism 110. The orifice restriction 118 is in the form of a one-way valve that may selectively be opened and closed in response to external forces. In these arrangements, the one-way valve opens in a direction away from the cavity 105 (thereby allowing the cosmetic substance 102 to be dispensed therefrom). The one-way valve 118 may have a specified hardness and/or rigidity value that prevents the valve from opening until a sufficient force is exerted thereon. As an example, the one-way valve 118 may be constructed from low density polyethylene, medium density polyethylene, high density polyethylene, or other elastomeric materials depending on the desired formula of the cosmetic substance 102 and its characteristics. Such a material may have a Shore D hardness value between approximately 50 and 70, and advantageously may be capable of repeatedly returning to a valve closed state despite repeatedly being subjected to external forces in addition to the cosmetic substance 102, which, in some examples, may be a relatively abrasive formulation.

Like other or all portions of the dispensing mechanism 110, in some examples, the one-way valve 118 may be constructed from a bi-injected soft touch material such as a fluorosilicate. As a result, when the desired cosmetic substance 102 is composed of strong, potentially abrasive chemical formulations, the dispensing mechanism 110 may safely retain and/or dispense the cosmetic substance 102 without degrading or otherwise deteriorating the device.

The applicator 120 has a body 122 and an external surface 124. A portion of the body 122 of the applicator may include a coupling region (not illustrated) that allows the applicator 120 to couple with the dispensing mechanism 110. More specifically, in some examples, the body 122 of the applicator 120 may include a rigid collar that engages a protrusion or a cavity formed on the base 112 of the dispensing mechanism 110. It is appreciated that in some examples, other suitable types of coupling mechanisms may be used to removably couple the applicator 120 with the dispensing mechanism 110 such as, for example, a threaded coupling, a tab and protrusion coupling, and the like. Other examples are possible. So configured, the body 122 of the applicator 120 is positioned adjacent to the orifice restriction 118 of the dispensing mechanism 110.

In some examples, the applicator 120 is constructed from a flocked soft foam having channels that allow the cosmetic substance 102 to flow from an interior cavity of the body 122 to the external surface 124 thereof. By using a flocked foam, the external surface 124 allows for a smooth application of the cosmetic substance 102. In some examples, the channels may be laser-cut. In other words, the applicator 120 may be micro-perforated to allow the cosmetic substance 102 to diffuse through and spread evenly at the external surface 124 of the applicator 120. In some examples, the applicator 120 is approximately 5 mm thick and may have a domed, slanted face having a petal shape that mimics a user's finger with a width of approximately 17 mm. In these and other examples, a tip of the applicator 120 may be pointed to allow for targeted application of the cosmetic substance 102. Other examples are possible. For example, in some approaches, the applicator 120 may have a tube (not illustrated) disposed therewithin. The tube may be constructed from any number of suitable materials such as, for example, a flexible member that moves and/or bends when pressure is applied to the applicator 120, but may still provide increased support during application of the cosmetic substance 102. In some examples, the tube may itself define a channel that directs the cosmetic substance 102 from the dispensing mechanism 110 to an upper end of the applicator 120. Other examples are possible.

The applicator system 100 may further include a cap 130 having a first end 130*a* and a body 132. As illustrated in FIGS. 5 & 6, the first end 130*a* of the cap 130 may be removably coupled with a portion of the flexible container 104. More specifically, in the illustrated example, the first end 130*a* of the cap 130 may frictionally engage the ledge 108 of the flexible container 104. It is appreciated that in other examples, the cap 130 may be threadably coupled with the flexible container 104. In yet other examples, the cap 130 may couple with the dispensing mechanism 110. Other suitable coupling mechanisms may be used. The body 132 of the cap 130 may be flared to allow for a larger applicator 120. Further, like the second end 104*b* of the flexible container 104, the cap 130 may be flat at an end or top surface to allow the applicator system 100 to stand upside down on a horizontal surface.

In operation, the applicator system 100 is prepared by filling the cavity 105 with the desired cosmetic substance 102. The dispensing mechanism 110 is then coupled with the flexible container 104 via the threaded coupling regions 114, 106, and the applicator 120 is then operably coupled with the base 112 of the dispensing mechanism 110. A user may then dispense the cosmetic substance by squeezing the flexible container 104 with sufficient force that causes the one-way valve 118 to open and urge the cosmetic substance 102 into the body 122 of the applicator 120. In some examples, the one-way valve 118 may close upon the user releasing the flexible container 104. In some examples, however, the one-way valve 118 may be configured to close upon releasing a specified volume and/or predetermined quantity of cosmetic substance 102. For example, the one-way valve 118 may close upon dispensing approximately 10 microliters of cosmetic substance 102. Other examples are possible. Advantageously, the desired dispensing volume may be adjusted by a manufacturer to dispense different types of cosmetic substances. Further, the dispensing mechanism 110 advantageously allows the cosmetic substance to be dispensed into the applicator 120 in an upright orientation.

The user may then apply the cosmetic substance 102 by pressing the external surface 124 of the applicator 120 against their skin, which causes the cosmetic substance 102 disposed within the body 122 of the applicator 120 to flow through the applicator 120 and onto the external surface 124 thereof. Upon applying the cosmetic substance 102, the user may secure the cap 130 with the flexible container 104.

In some examples (not illustrated), alternative dispensing mechanisms may be provided. For example, a dispensing mechanism may be in the form of a dip tube plunger that extends into the cavity 105 of the flexible container. Such a mechanism may draw or collect the cosmetic substance 102 into the applicator 120 upon engaging or otherwise squeezing the flexible container 104. As before, such a dispensing mechanism may advantageously allow the cosmetic substance 102 to be dispensed into the applicator 120 in an upright orientation.

Because the applicator system 100 includes threadable or otherwise removable components, the applicator 120 may be separated from the remainder of the applicator system 100 as desired and interchanged with different applicators having desired geometries and/or other characteristics such as, for example, softer or more rigid foam materials. Accordingly, the system 100 may be customizable to meet varying consumer demands. Such a removable arrangement further allows the applicator 120 to be adequately cleaned and replaced as needed, which may be advantageous in retail environments to promote hygienic practices.

Further, the applicator system 100 may be reusable. More specifically, in some examples, upon using all of the cosmetic substance 102, a user may remove the flexible container 104 from the dispensing mechanism 110 and return the flexible container 104 to the manufacturer. The user may then purchase a standalone container 104 having a seal or cap arrangement (not illustrated) on the first end 104*a* thereof, and subsequently couple the dispensing mechanism 110 therewith. Such a system may result in significant reductions in packaging waste.

So configured, the system allows a consumer to actuate, apply, and blend the product in a single swipe or motion. The applicator head geometry allows the product to diffuse to the surface for a more homogenous application, while the pointy upper region of the applicator head provides better application. By providing two orifice restrictions, displacement within the dispensing mechanism is accurately controlled, which is not possible with existing systems and pumping mechanisms. Further, because each of the components are removably coupled with each other, the system 100 may be readily customized as desired by a user.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. An applicator system for containing and dispensing a cosmetic substance, the applicator system comprising:

a flexible container defining a cavity configured to be filled with the cosmetic substance, the flexible container including an open first end and a closed second end, the open first end including a neck portion extending toward the closed second end, the flexible container further including a ledge extending radially from the neck portion wherein the ledge has a first portion extending toward the closed and a second portion extending outwardly from a lower end of the first portion;

a dispensing mechanism disposed at or near the open first end of the flexible container, the dispensing mechanism including a base covering the open first end of the flexible container, a threaded coupling region extending from the base and configured to couple with the neck portion of the flexible container, and a sidewall extending from the base and surrounding the threaded coupling region, a lower end of the sidewall engaging an upper end of the first portion of the ledge of the flexible container when the threaded coupling region is coupled with the neck portion of the flexible container;

an applicator operably coupled with at least a portion of the dispensing mechanism, the applicator having a body and an external surface; and a cap having a lower portion engaging the second portion of the ledge of the flexible container when coupled to the flexible container;

wherein upon exerting a force on a portion of the flexible container, a predetermined quantity of cosmetic substance is dispensed from the cavity, through the dispensing mechanism, through the body of the applicator to the external surface thereof.

2. The applicator system of claim 1, wherein the neck portion is adapted to flex in response to the applicator being urged by a user.

3. The applicator system of claim 1, wherein the dispensing mechanism includes at least one orifice restriction.

4. The applicator system of claim 3, wherein the at least one orifice restriction is constructed from a material having a Shore D hardness between 50 and 75.

5. The applicator system of claim 3, wherein the at least one orifice restriction includes a one-way valve adapted to close upon dispensing the predetermined quantity of cosmetic substance.

6. The applicator system of claim 5, wherein the predetermined quantity of cosmetic substance is 10 microliters.

7. The applicator system of claim 1, wherein the dispensing mechanism is adapted to extend into the cavity towards the second end of the flexible container.

8. The applicator system of claim 1, wherein the body of the applicator includes a flow through head adapted to diffuse the cosmetic substance to the external surface thereof.

9. The applicator system of claim 1, wherein the applicator is constructed from an open cell foam material.

10. The applicator system of claim 1, wherein the flexible container has a rectangular or an ovoid shape.

11. The applicator system of claim 1, wherein the flexible container has a tapered profile extending from the first end to the second end.

* * * * *